US006053542A

United States Patent [19]

Ostrowski et al.

[11] Patent Number: 6,053,542

[45] Date of Patent: Apr. 25, 2000

[54] VEHICLE DOOR LATCH WITH CINCHING MECHANISM

[75] Inventors: Artur Jerzy Ostrowski, Rochester Hills; Joseph Leon Bastien, Armada, both of Mich.

[73] Assignee: General Motors Corporation, Detroit, Mich.

[21] Appl. No.: 09/105,891

[22] Filed: Jun. 26, 1998

[51] Int. Cl.[7] ..... E05C 3/06

[52] U.S. Cl. ..... 292/201; 292/216; 292/DIG. 23; 292/DIG. 27

[58] Field of Search ..... 292/201, 216, 292/341.16, DIG. 23, DIG. 46, DIG. 62, DIG. 27

[56] References Cited

U.S. PATENT DOCUMENTS

| | | | |
|---|---|---|---|
| 4,756,563 | 7/1988 | Garwood et al. | 292/216 |
| 5,054,827 | 10/1991 | Konchan et al. | 292/216 |
| 5,232,253 | 8/1993 | Tamiya | 292/201 |
| 5,277,461 | 1/1994 | Dzurko et al. | 292/216 |
| 5,288,115 | 2/1994 | Inoue et al. | 292/201 |
| 5,466,021 | 11/1995 | Ishihara et al. | 292/201 |
| 5,520,425 | 5/1996 | Dowling | 292/201 |
| 5,522,626 | 6/1996 | Dominique | 292/198 |
| 5,564,761 | 10/1996 | Mizuki et al. | 292/201 |
| 5,639,130 | 6/1997 | Rogers, Jr. et al. | 292/216 |
| 5,785,364 | 7/1998 | Kleefeldt et al. | 292/201 |

*Primary Examiner*—Darnell M. Boucher
*Assistant Examiner*—Clifford B Vaterlaus
*Attorney, Agent, or Firm*—Charles E. Leahy

[57] ABSTRACT

A vehicle door latch has a rotatable forkbolt that is latched by a detent in a primary or an intermediate secondary latch position. The detent is operated via an intermittent lever that is operated by a transfer lever that is actuated by inside and outside door handles via suitable mechanical linkage. The door latch includes a locking lever that disables the door handles from operating the intermittent lever when it is in the locked position. The door latch also includes a cinching mechanism that automatically engages the forkbolt in the primary latch position when the intermediate secondary latch position is reached. The cinching mechanism includes a link that has one end connected to a cinch pawl and another end connected to the latch assembly. The link pulls on the pawl to disengage it from a cinching gear to allow the cinching gear to return to the standby or home position during an unlatching operation.

8 Claims, 9 Drawing Sheets

VEHICLE DOOR LATCH WITH CINCHING MECHANISM

TECHNICAL FIELD

This invention relates generally to vehicle door latches and more particularly to vehicle door latches that have a primary and an intermediate latching position.

BACKGROUND OF THE INVENTION

It is known to provide a cinching mechanism for power operation of a latch to assist vehicle users in closing a door or hatch against weather seal pressure. Cinching mechanisms have been developed to drive the forkbolt of a latch from an intermediate secondary latch position to the primary latch position. These cinching mechanisms are powered and operate via a motor or other electrically driven mechanism. The cinching mechanisms often require redesigning the latch assembly itself to accommodate the powerdrive mechanism for the cinching mechanism. Furthermore, latches that have these cinching mechanisms need a manual override to allow the latch to be opened in a situation where electric power is lost or the actuating motor for the cinching mechanism otherwise becomes inoperable.

What is desired is a cinching mechanism that can be incorporated in a compactly packaged assembly with a standard latch assembly that includes a manual override and provides for good and consistent mechanical advantage during the manual release of the cinching mechanism.

SUMMARY OF THE INVENTION

In accordance with one aspect of the invention, a cinching mechanism for a vehicle latch assembly has a cinching gear rotatably mounted about an axis between a standby and latched or closed position. The cinching gear is operatively interacting with the latch assembly. The cinching gear further includes a notch radially spaced away from its pivot axis. A cinch pawl is operably movable between a corresponding standby and latched position. The cinch pawl is connected to an actuator and biased against the cinching pawl for engagement with the notch of the cinching gear. The cinch pawl drives the cinching gear to its latched position. The cinching gear can be retracted to its standby position for allowing the cinching pawl to rotate back to its standby position.

A cinch drive lever is pivotally mounting the cinch pawl along a first pivot axis and is pivotably mounted in proximity to the pivot axis of the cinching gear. It is desirable that the cinching gear and cinch drive lever are coaxially mounted. The cinch drive lever is operably connected to an actuator for driving the cinch pawl between its standby and latched position. Preferably the connection to the actuator is via a cable that is in turn operably connected to a reversible motor.

A link is pivotably connected to the cinch pawl near one end and extends to and is connected near its other end to the latch assembly for pivotably disengaging the cinch pawl from the cinching gear in response to unlatching action of the latch assembly. The link is in proximity to the pivot axis of the cinching gear such that a line between its one and other end crosses said pivot axis of the cinching gear during motion of the pawl between its standby and latched positions. Preferably the link is straight and rigid and follows the line between the two ends. The link preferably has a slot near its other end for connection to the latch assembly.

It is preferable that the cinching gear, cinch drive lever and cinch pawl are housed in a casing and that the link that connects to the latch assembly is located on the exterior of the casing.

In accordance with another aspect of the invention, a cinching mechanism is in combination with a latch assembly. The latch assembly includes a forkbolt having a gear section and a primary detent and biased to rotate to an open position. A detent lever is engageable with the primary detent and operable to lock the forkbolt from rotating. An operating lever is pivotably mounted in the latch assembly and an intermediate lever is engageable with the operating lever and linked to the detent lever. The cinching mechanism is mounted on the latch assembly such that the cinching gear is rotatable about an axis between a standby and latched position and operatively engaged with the gear section of the forkbolt.

In this fashion, a vehicle door latch has a cinching mechanism that shifts out of the way to avoid interference with an intentional unlatching operation that is either powered or manually actuated. The vehicle door latch has a cinching mechanism that includes a release mechanism that automatically uncouples the cinching mechanism during a conventional unlatching operation. These features are accomplished with a compactly assembled linkage and cinch pawl assembly through a particular geometry and advantageous placement of the link and cinch pawl.

BRIEF DESCRIPTION OF THE DRAWINGS

Reference now is made to the accompanying drawings in which.

DETAILED DESCRIPTION OF THE PREFERRED EMBODIMENT

Figure 1:
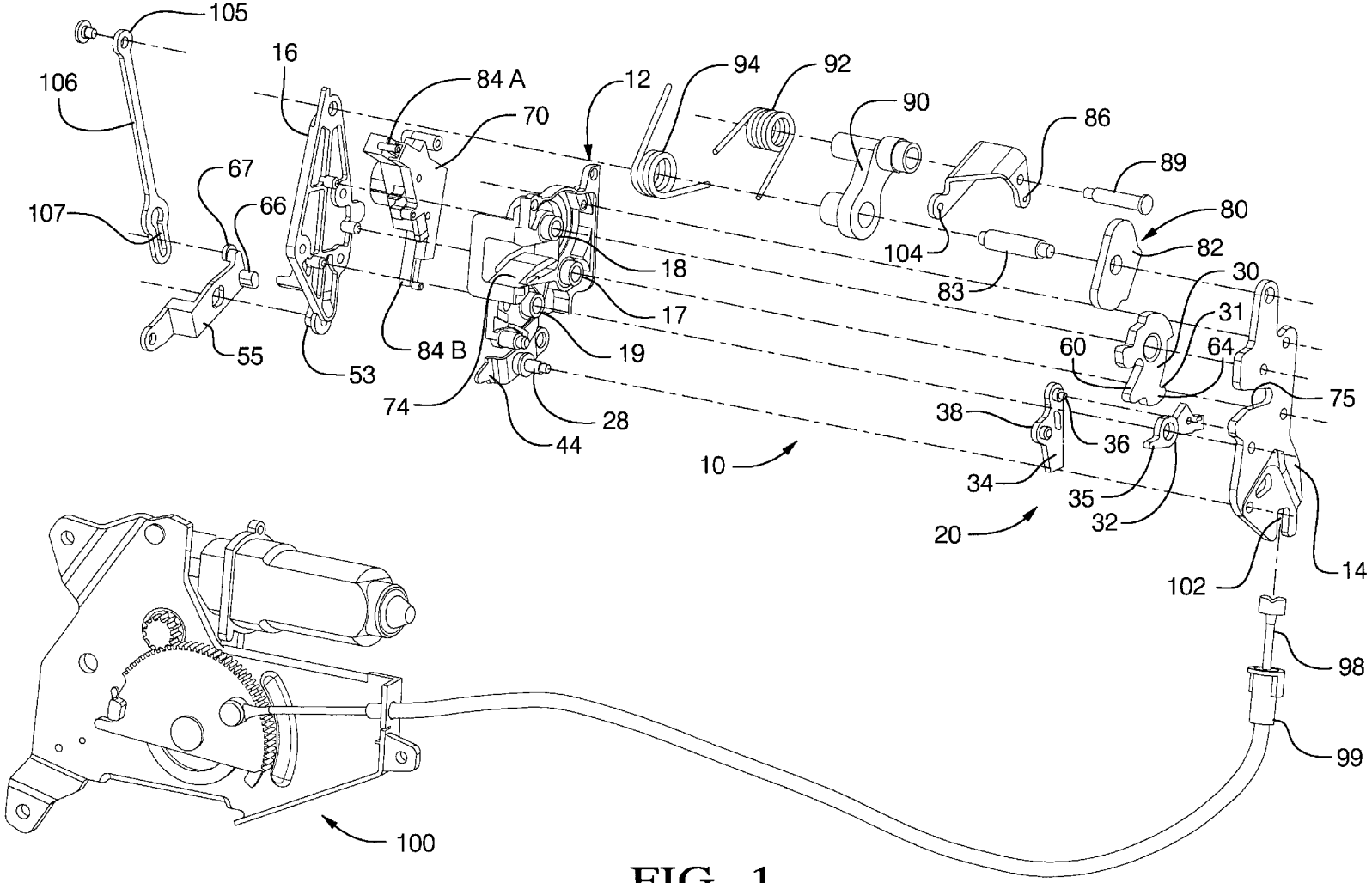
FIG. 1 is an exploded perspective partially schematic view of a vehicle door latch according to the present invention.
Figure 2:
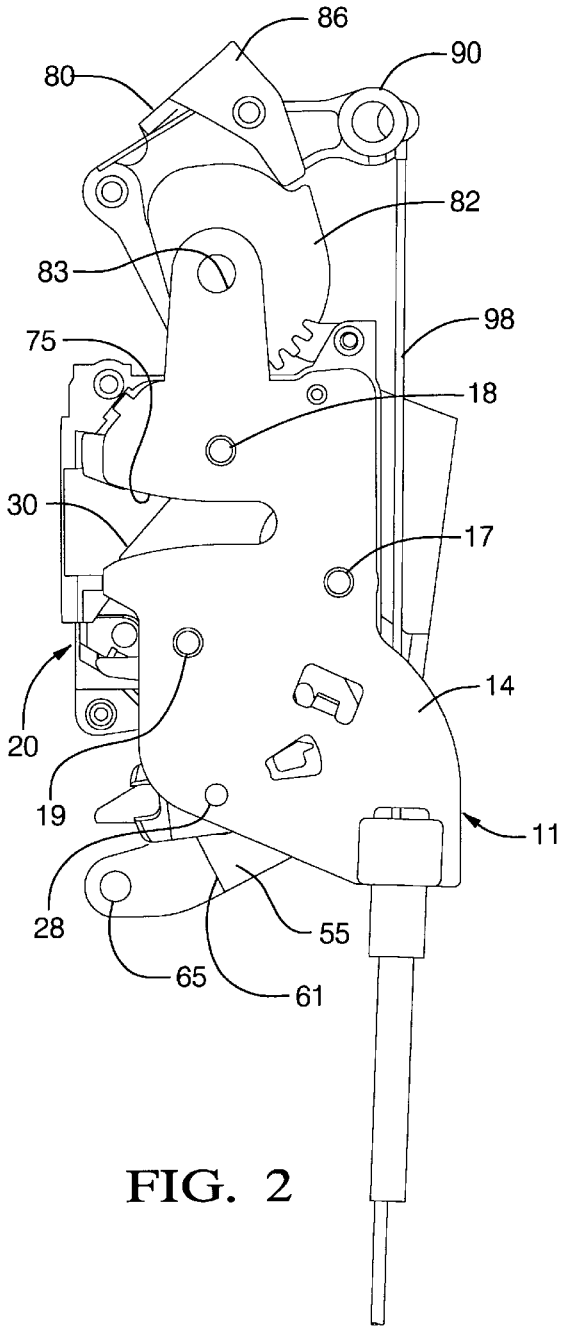
FIG. 2 is a front elevational view of the vehicle door latch shown in FIG. 1 showing the door latch in the open and unlocked position.
Figure 3:
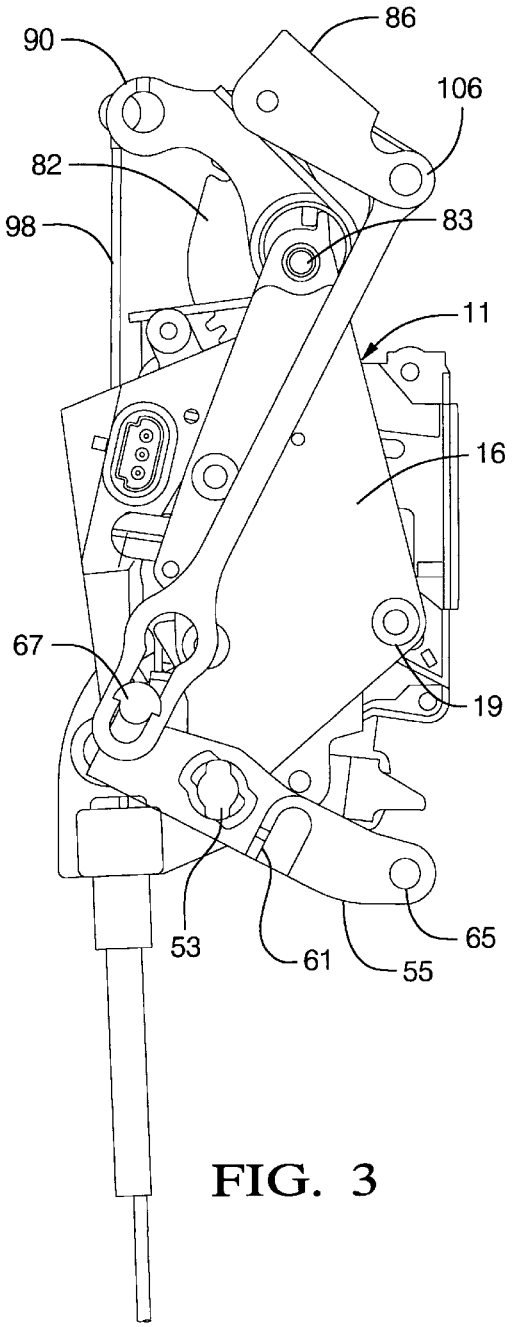
FIG. 3 is a rear elevation view of the vehicle door latch shown in FIG. 2.
Figure 4:
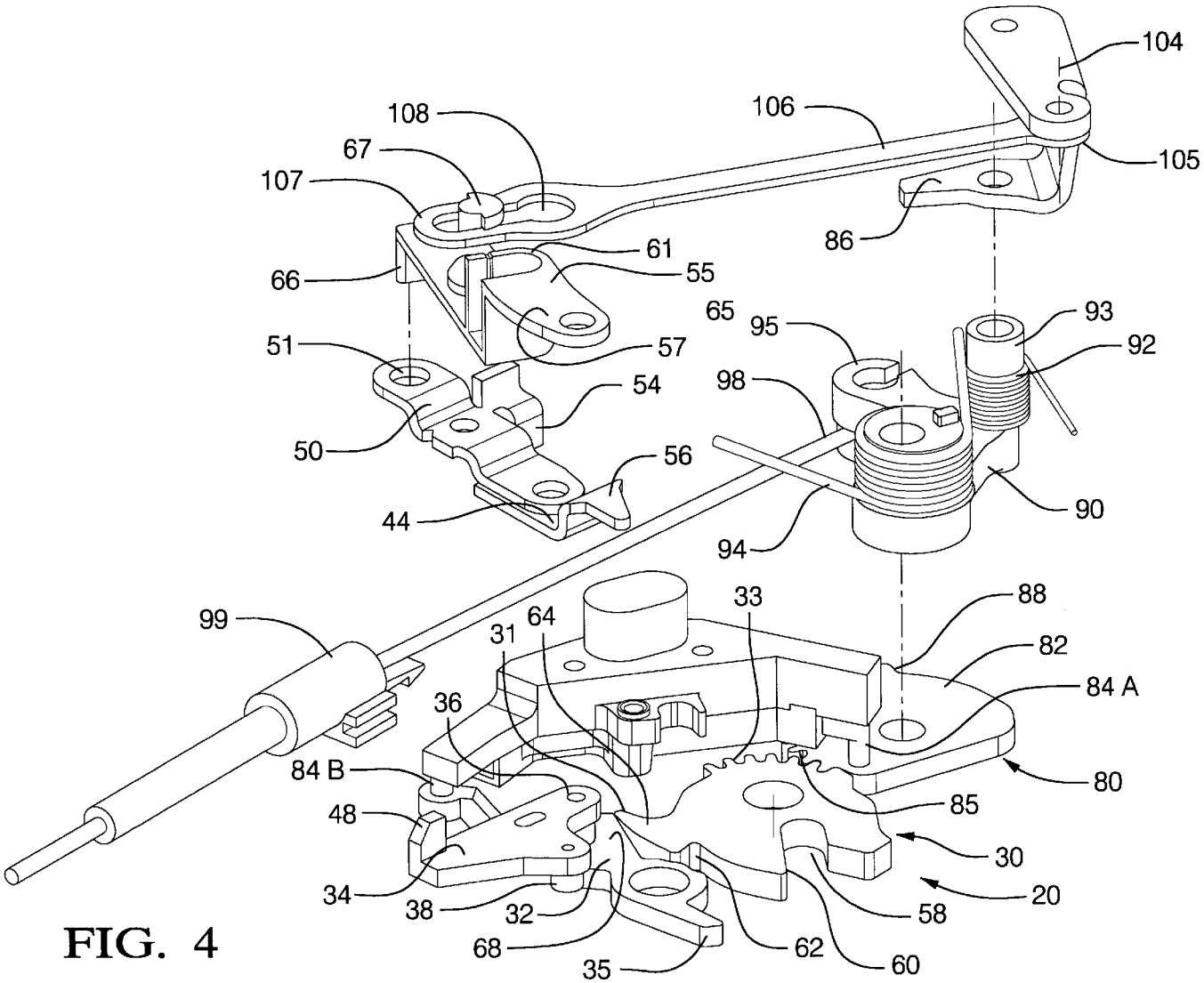
FIG. 4 is an enlarged rear perspective and exploded view illustrating the operative elements of the latch assembly and the cinching mechanism.

Referring now to the drawings and more particularly to FIGS. 1, 2, and 3, the vehicle door latch mechanism 10 is the same basic arrangement as the vehicle door latches that are disclosed in U.S. Pat. No. 5,277,461 granted to Thomas A. Dzurko et al Jan. 11, 1194 for a vehicle door latch, U.S. Pat. No. 4,756,563 granted to Stephen L. Garwood and Jeffrey Konchan Jul. 12, 1988 for a vehicle door latch. U.S. Pat. No. 5,054,827 granted to Jeffrey L. Konchan and Jiri Paulik Oct. 8, 1991 for a vehicle door latch, and U.S. Pat. No. 5,918,917 granted to Robert Douglas Elton and Lyloyd Walker Rogers, Jr. Jul. 6, 1999 for a vehicle door latch with cinching mechanism all of which are hereby incorporated in this patent specification by reference.

Briefly, the vehicle door latch 10 has a multipiece casing 11 that comprises plastic housing 12, metal face plate 14 and metal back plate 16. The plastic housing 12 and the metal back plate 16 are conventionally bolted together through mounting bushings 17, 18 and 19 to form the casing 11.

Figure 5:
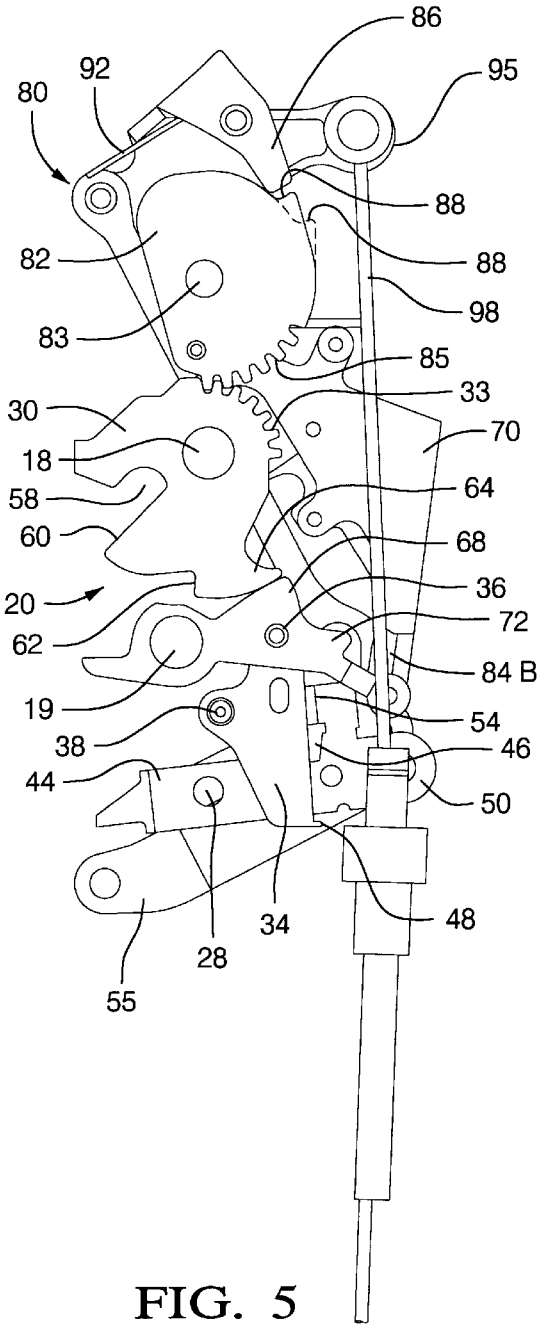
FIG. 5 is a fragmentary front elevational view of the vehicle door latch showing the door latch in an unlatched, unlocked and open condition.
Figure 6:
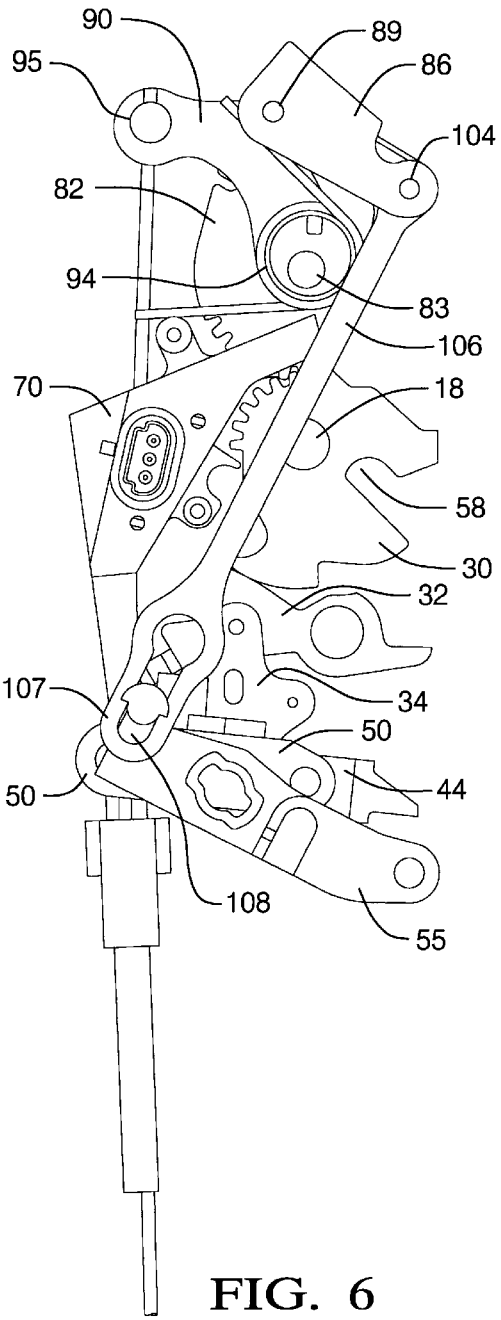
FIG. 6 is a fragmentary rear elevational view of the vehicle door latch of FIG. 5.

The latching mechanism 20 of the vehicle door latch 10 comprises a forkbolt 30 and a cooperating detent 32 that are pivotally mounted on bushings 18 and 19 respectively and located in a chamber of the plastic housing 12 behind the metal face plate 14. The forkbolt 30 is conventionally biased clockwise as shown in FIG. 1 by a coil spring not shown for simplicity of the drawing. Detent 32 is biased counterclockwise into engagement with the forkbolt 30 by a another coil spring (also not shown for simplicity of the drawing). Detent 32 engages the forkbolt 30 in its unlatched position as shown in FIGS. 5 and 6 and engages and holds the forkbolt lever 30 in intermediate secondary and primary latched positions against the opening bias of forkbolt 30 as shown in FIGS. 7–12.

The latching mechanism further comprises an intermittent lever 34 for operating the detent 32. The intermittent lever 34 is located in the chamber of the plastic housing 12 behind detent 32. It has two integral pivot pins 36 and 38. Pivot pin 36 is journalled in a hole in detent 32 so that the detent 32 rotates clockwise from the position shown in FIGS. 7 or 9 to the unlatched position and out of latched engagement with the forkbolt 30 to the unlatched position shown in FIG. 13 when the intermittent lever 34 is pulled down. The pivot pin 38 is disposed in a slot of a locking lever (not shown) that pivots the intermittent lever 34 counterclockwise about pivot pin 36 as shown in FIG. 5 from the unlock position shown in FIGS. 5–13 to a lock position (not shown).

The latching mechanism further comprises a transfer lever 44 that is journalled on a stud 28. The transfer lever 44 has an ear 46 at one end that is engageable with an integral, rearwardly projecting tab 48 of the intermittent lever 34 so that the intermittent lever 34 is pulled down when the transfer lever 44 is rotated clockwise as viewed in FIG. 13.

Figure 13:
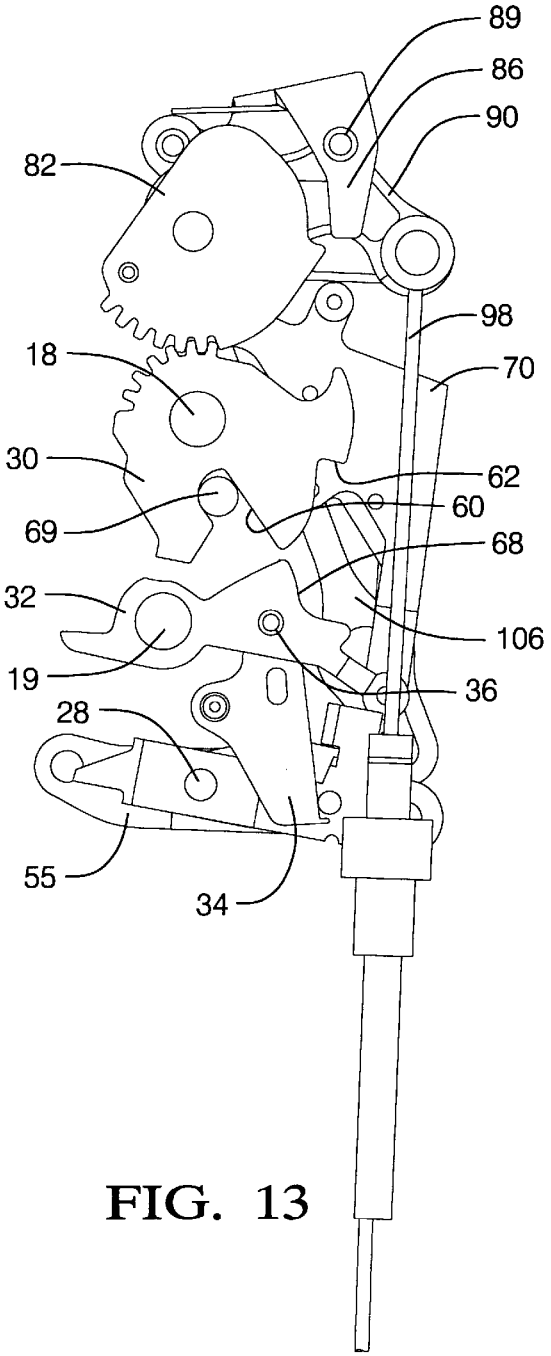
FIG. 13 is a fragmentary front elevational view showing the vehicle door latch in the process of being intentionally unlatched with the motor in the full cinch state.

The latching mechanism further comprises an outside operating lever 50. The outside operating lever 50 is also journalled on the stud 28 behind the transfer lever 44. It has a bent tab 54 that engages the ear 46 of the transfer lever 44 so that the outside operating lever 50 rotates the transfer lever 44 clockwise when it is rotated clockwise on stud 28 as shown in FIGS. 5 and 13. The outside operating lever 50 is connected by suitable linkage for rotation by an outside door handle (not shown). The transfer lever 44 and outside operating lever 50 are conventionally biased counterclockwise as shown in FIGS. 5 and 13 to a rest position where tab 54 engages the bottom of the plastic housing 12 by a coil spring not shown mounted about stud 28.

The latching mechanism further comprises an inside operating lever 55 that is pivotally mounted about pin 53 of the metal backplate 16. Tab 66 on lever 55 engages with aperture 51 on lever 50 so that the inside operating lever rotates lever 50 in the clockwise direction. The inside operating lever 55 is connected by suitable linkage at section 61 for rotation by an inside door handle (not shown) or through an automated actuator through connecting point 65. The inside operating lever has a connecting flange 67 at the opposite distal end. On the other side of the flange, a tab 66 drivingly engages aperture 51 in the outside operating lever 50.

Forkbolt 30 has a conventional slot or throat 58 for receiving and retaining a strike member 69, that is attached to the vehicle door pillar to latch the vehicle door in the closed position. Forkbolt 30 also includes a primary latch shoulder 60, an intermediate secondary latch shoulder 62 and a radially projecting foot 64. Forkbolt 30 can have a plastic coating (not shown) that covers a surface of the slot 58 that is engaged by the strike member 69 for energy absorption and quiet operation when the vehicle door is slammed shut.

Detent 32 has a sector shaped catch 68 that engages the radially projecting foot 64 when the forkbolt 30 is in the unlatched position as shown in FIG. 5. The sector shaped catch 68 positively engages the primary and intermediate secondary latch shoulders 60 and 62 to hold the forkbolt 30 in either the primary or the intermediate secondary latched positions shown in FIGS. 9 and 7 respectively. Detent 32 also includes an integral bumper 72. The bumper 72 engages a stop in casing 11 to stop counterclockwise pivoting of the detent lever 32 under the bias of spring 52. This bumper 72 which can be coated in plastic also absorbs energy and quiets operation when the door is slammed shut.

Figure 7:
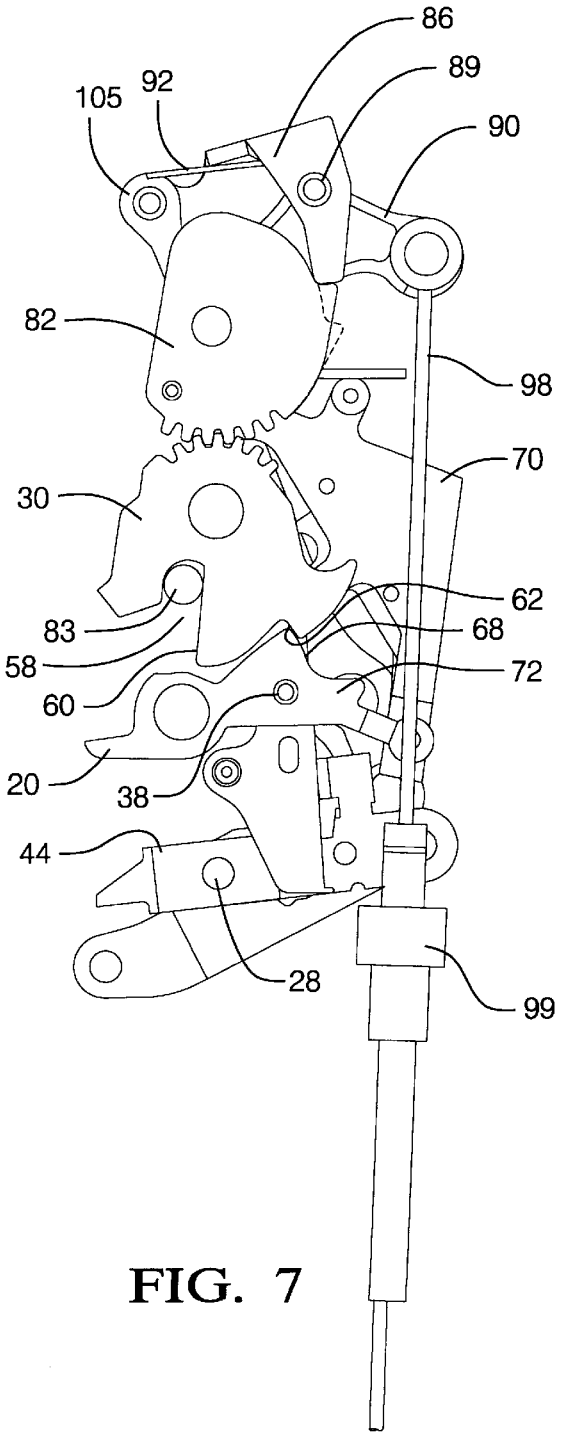
FIG. 7 is a fragmentary front elevational view showing the vehicle door latch in an intermediate secondary latched and unlocked condition with the cinch motor halfway through its pull stroke.
Figure 8:
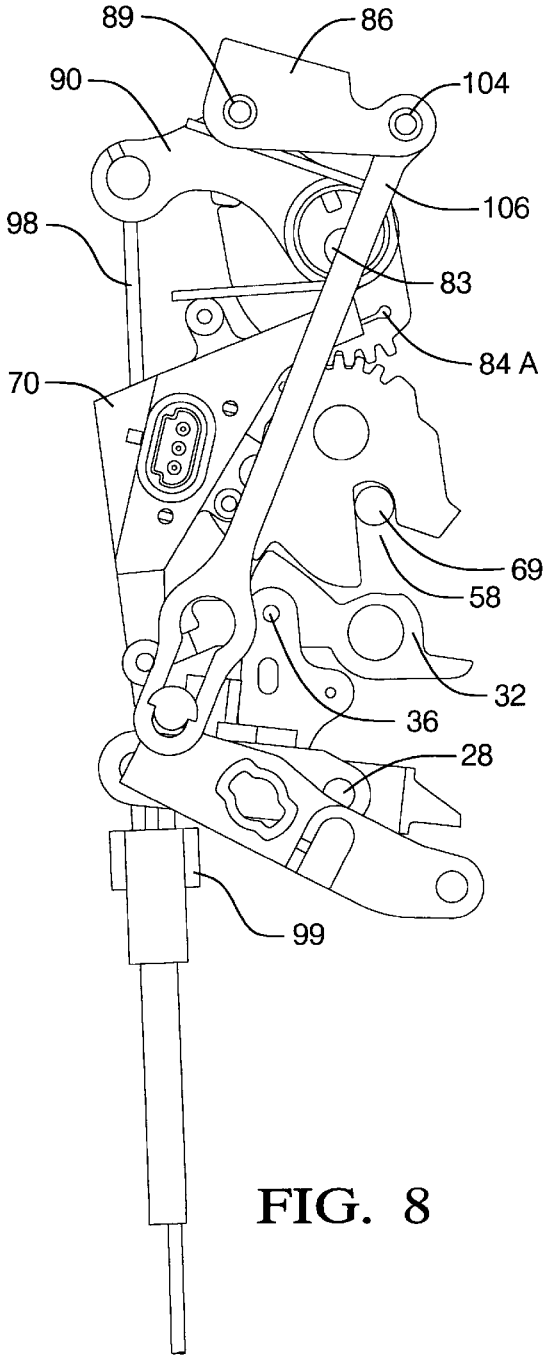
FIG. 8 is a fragmentary rear elevational view of the vehicle door latch shown in FIG. 7.

The conventional latching mechanism described above operates as follows. When the door latch 10 is in an unlatched and unlocked condition as shown in FIG. 5, forkbolt 30 is poised to receive a conventional strike member 69 that projects into aligned fish mouth slots 74 and 75 of the plastic housing 12 and the metal face plate 14 when the door is shut. The entering strike member 69 engages the shoulder 60 at the back of the throat 58 and rotates forkbolt 30 counterclockwise against its spring bias through the secondary position as shown in FIG. 7 and further until forkbolt 30 is rotated to the primary latch position shown in FIG. 9 where forkbolt 30 captures the strike member 69 in the throat 58. Forkbolt 30 is held in the primary latch position by catch 68 of detent 32 engaging the primary latch shoulder 60 of forkbolt 30.

Figure 9:
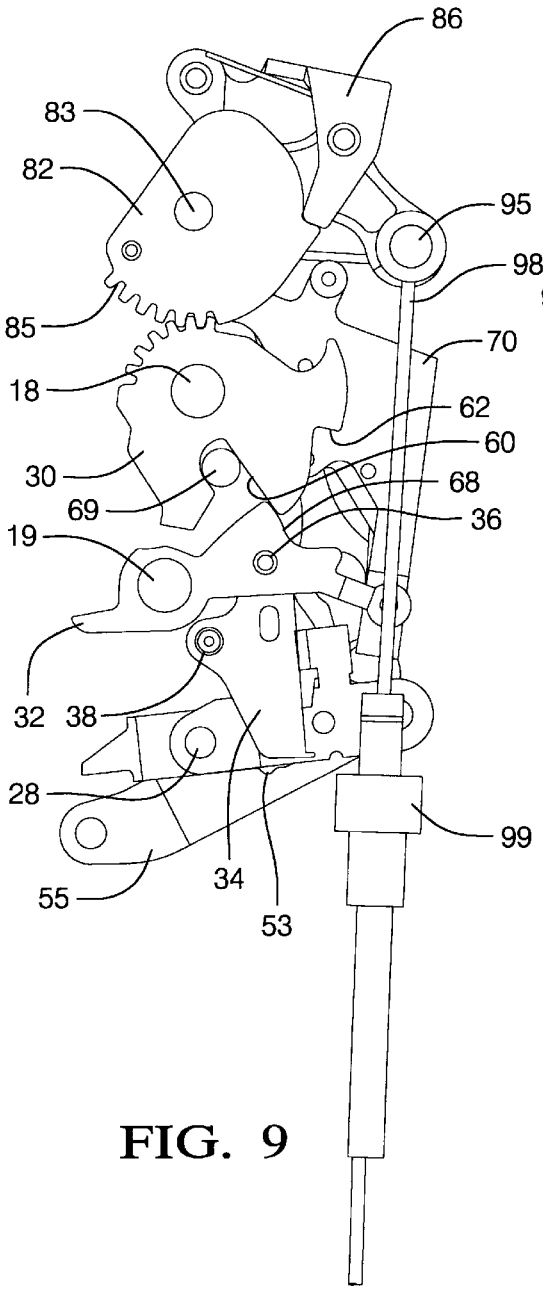
FIG. 9 is a fragmentary front elevational view showing the vehicle door latch in the final stage of being automatically driven from the secondary latched condition to a primary latched and unlocked condition.
Figure 10:
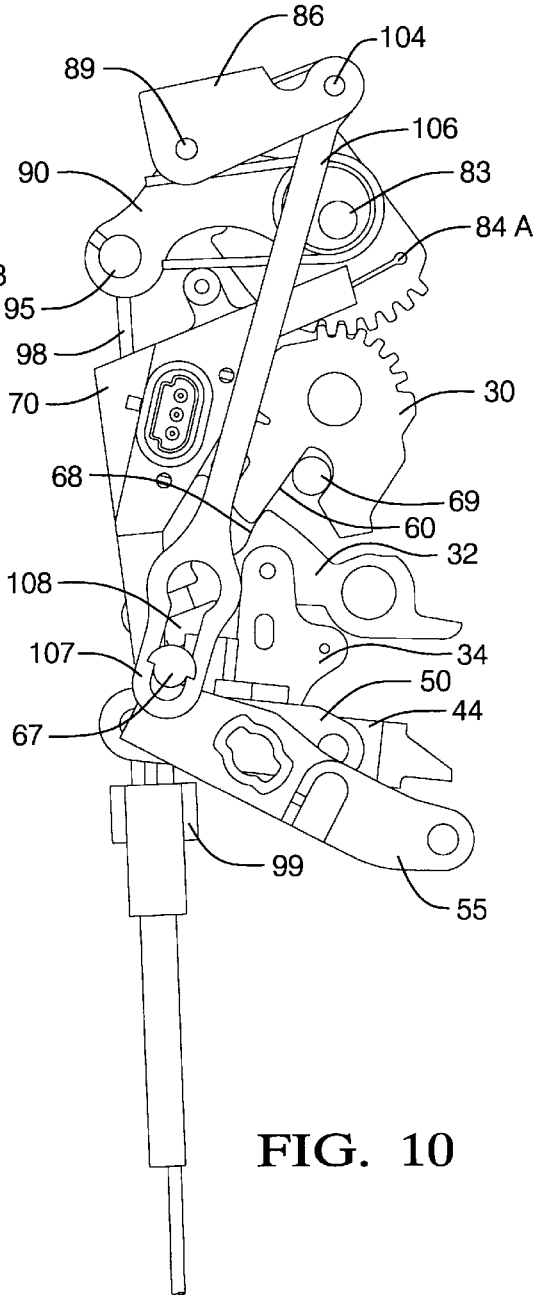
FIG. 10 is a fragmentary rear elevational view of the vehicle door latch shown in FIG. 9.

Catch 68 rides along the periphery of the forkbolt 30 under it spring bias as forkbolt 30 rotates counterclockwise from the unlatched position shown in FIG. 5 to the primary latch position shown in FIG. 9. During this travel, catch 68 rides under the foot 64 into engagement with the intermediate secondary latch shoulder 62 as shown in FIG. 7 and then into engagement with the primary latch shoulder 60 as shown in FIG. 9. It is to be noted that the engagement of catch 68 with the intermediate secondary latching shoulder 62 is sufficient to hold the vehicle door closed in the event that the vehicle door is not shut with sufficient force so that catch 68 engages primary latch shoulder 60.

Figure 15:
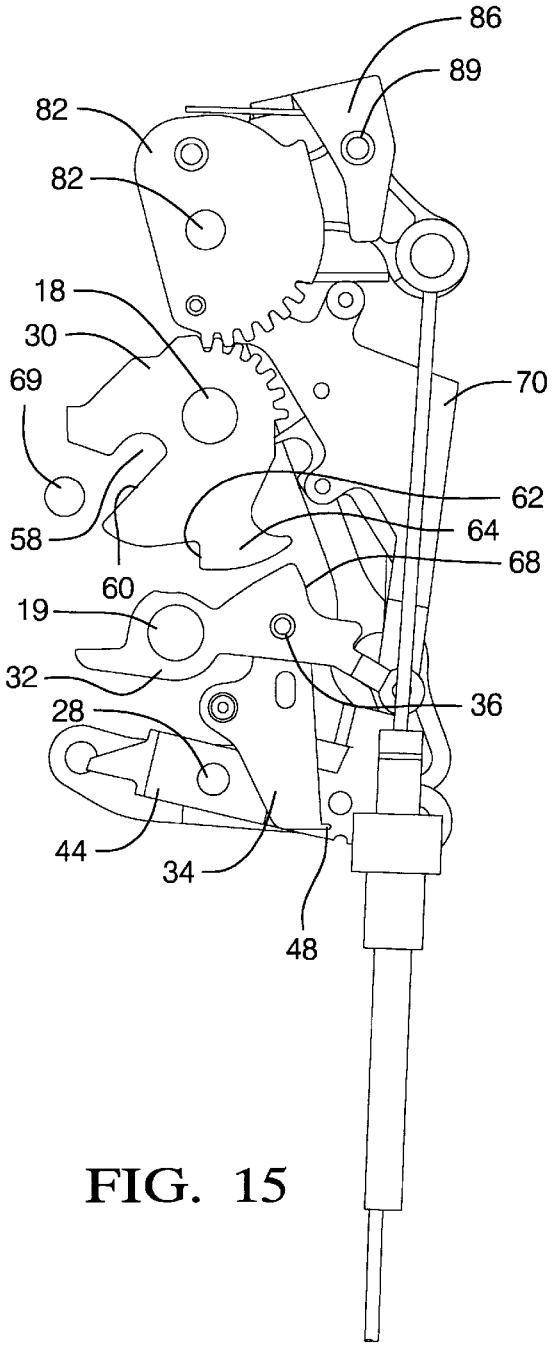
FIG. 15 is a fragmentary front elevational view showing the vehicle door latch open after release while the cinch motor is in the fall cinch state.
Figure 16:
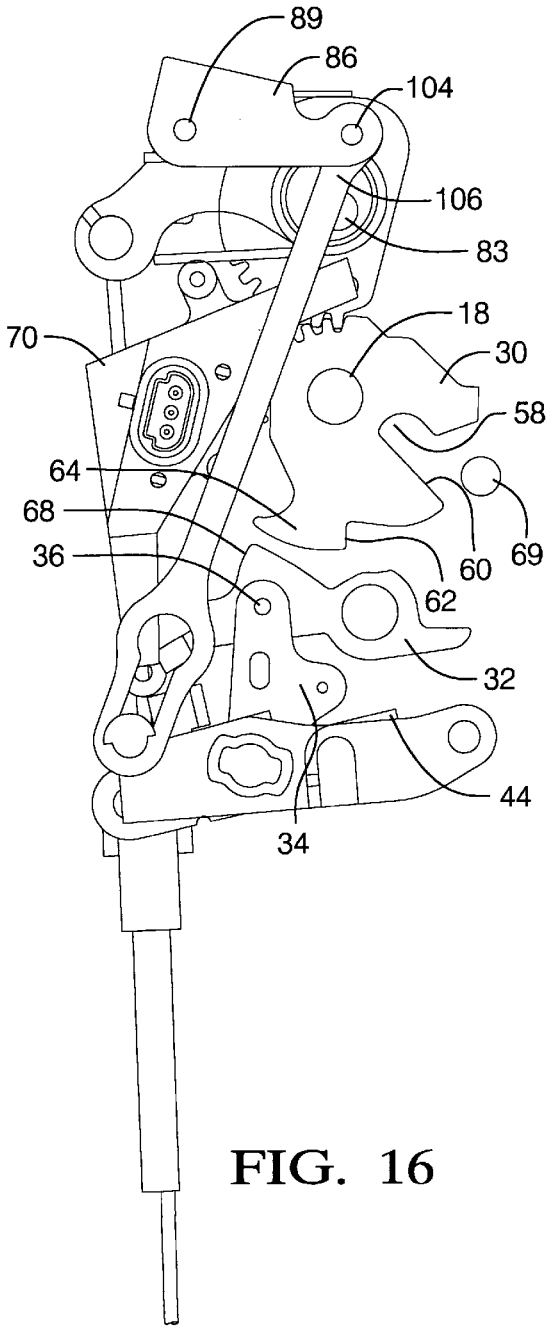
FIG. 16 is a fragmentary rear elevational view showing the vehicle door latch in FIG. 15.

When the vehicle door latch 10 is not locked, the vehicle door can be opened simply by operating either an inside or outside door handle or the like to rotate the transfer lever 44 clockwise and the ear 46 down as viewed in FIGS. 13 and 15. Ear 46 engages projection 48 of intermittent lever 34 and pulls the intermittent lever 34 down from the primary latch position shown in FIGS. 9 and 11 to the unlatched position shown in FIGS. 13 and 15. As the intermittent lever 34 is pulled down, it rotates detent 32 clockwise against its spring bias from the primary latch position shown in FIGS. 9 and 11 to the unlatched position shown in FIGS. 13 and 15. Forkbolt 30 is then free to rotate counterclockwise under its spring bias from the primary latch position shown in FIG. 13 to the unlatched position shown in FIG. 15 as the strike member 69 is pulled out of the aligned fishmouth slots 74 and 75 when the vehicle door is opened.

The operation of the locking lever and the locking mechanism does not form a part of this invention and hence the elements of the locking mechanism have been omitted for clarity. Briefly the locking lever is moved by suitable linkages that are controlled inside and outside the vehicle electrically or mechanically to lock or unlock the door latch 10. The locking lever can move the intermittent lever 34 counterclockwise about pivot pin 36 to a position where it is uncoupled from and out of the path of travel of transfer lever 44 described below which causes the lock condition of the latch. Intermittent lever 34 is thus rotated from the unlocked position shown in FIGS. 5–16 to a locked position where projection 48 is repositioned out from under ear 46 of transfer lever 44. Consequently when the door handles or the like are operated so as to rotate the transfer lever 44 clockwise to the unlatching position, the ear 46 simply bypasses the projection 48 without transferring any motion to the intermittent lever 34. Consequently intermittent lever 34 is not pulled down to rotate detent 32 to the unlatch position shown in FIG. 13. In other words the transfer lever 44 simply free wheels so that operation of the door handles or their equivalent is not effective. A complete description of the locking lever and locking mechanism is given in the three patents cited above that have been incorporated in this patent specification by reference. All figures in this specification show the lock lever 34 in the unlock condition.

The Cinching Mechanism

Figure 11:
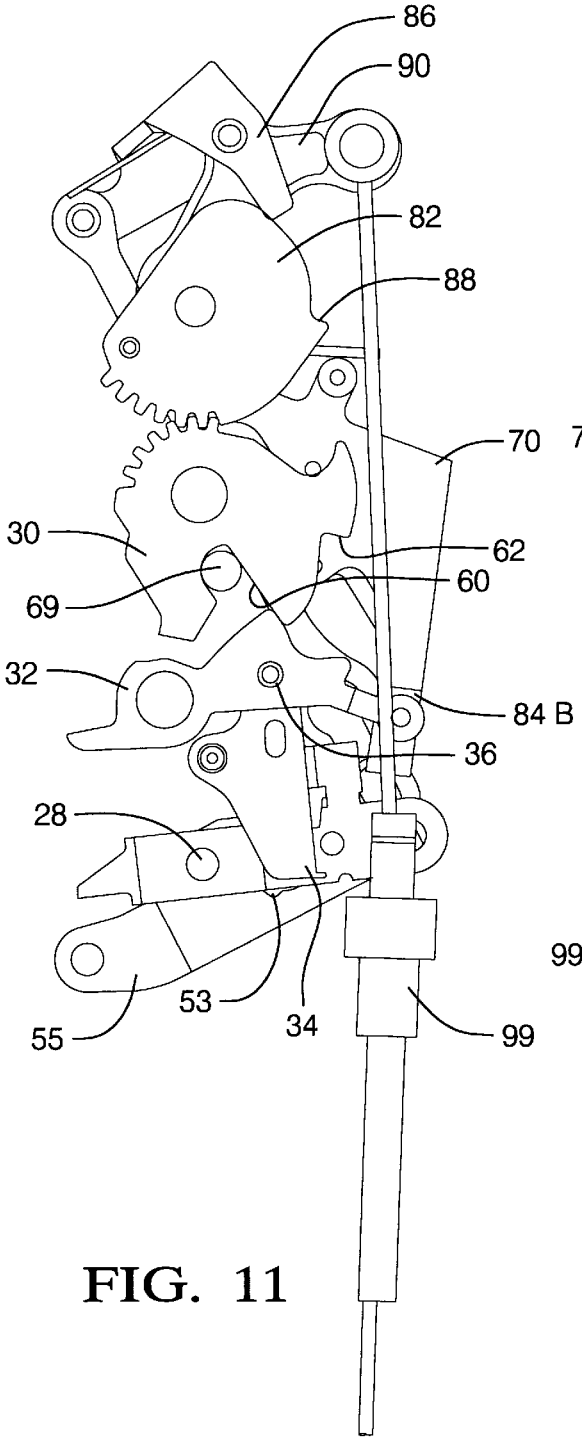
FIG. 11 is a fragmentary front elevational view showing the vehicle door latch in the primary latched and unlocked condition and the cinching drive lever and cinch pawl in the standby or home position.

The cinching mechanism, indicated generally at 80 supplements the conventional operation of the latching mechanism by assuring that detent 32 engages the primary latch shoulder 60 of forkbolt 30 as shown in FIGS. 9 and 11 when the forkbolt 30 has been moved toward a latch position by a predetermined amount such as when the secondary latch position is obtained as shown in FIG. 7.

Cinching mechanism 80 comprises a cinching gear 82 that is rotatably mounted in housing 12 above forkbolt 30 by an axle pin 83 that turns in journals in housing 12 and face plate 14. Cinching gear 82 is drivingly connected to forkbolt 30 by respective meshing integral sector gear portions 85 and 33 so that cinching gear 82 moves between an unlatched position as shown in FIG. 5 in solid and a primary latch position as shown in FIGS. 9 and 11 via an intermediate secondary latch position as shown in phantom in FIG. 5 and solid in FIG. 7) corresponding to the respective positions of forkbolt 30. A switch member 84 is carried by cinching gear 82. Cinching gear also has a notch 88 about its periphery.

Cinching mechanism further comprises a drive cinch pawl member 86 that engages notch 88 of cinching gear 82 and drives forkbolt 30 to the primary latch position via cinching gear 82 as explained below. Cinch pawl member 86 is rotatably carried by a pin 89 on a drive lever 90 and is spring biased against cinching gear 82 by a spring 92 mounted about pin and integral spring seat 93 on drive lever 90.

Drive lever 90 is pivotably mounted through the same pin 83 that mounts the cinching gear 82 to be coaxially mounted with cinching gear 82. A coil spring 94 biases the drive member 90 counter clockwise as shown in FIG. 5 (clockwise as shown in FIG. 6). The distal end 95 is attached to the end of a pull cable 98 that is attached to a reversible electric motor 100 that is shown in FIG. 1 and that is connected electrically by wires not shown to the position switch 84 in switch housing 70. The sheath 99 for pull cable 98 has one end attached to a flange 102 of face plate 14 by a suitable connector.

The cinch pawl member 86 is also pivotably connected at a point 104 spaced from pin 89 to an upper end 105 of link 106 which has its lower end 107 having a mounting slot 108 for receiving and pivotably mounting flange 67 of inside operating lever 55. The link 106 passes in proximity to pivot pin 83 of the cinching gear 82 and drive lever 90. Link 106 is also mounted to the exterior of the casing 11 from the pawl 86 to the operating lever 55 as clearly shown in FIG. 3.

Operation of the Cinching Mechanism

The cinching mechanism 80 operates as follows with reference to FIGS. 5–16. When the vehicle door is open, the door latch 10 is in an unlatched position as shown in FIGS. 5 and 6. As the vehicle door closes, the strike member 69 in the vehicle doorjamb engages throat 58 of forkbolt 30 rotating forkbolt 30 counterclockwise which drives cinching gear 82 and switch member 84 on cinching gear 82 clockwise as shown in phantom in FIG. 5. When forkbolt 30 reaches the intermediate secondary latch position shown in FIGS. 7 and 8, detent 32 engages secondary latch shoulder 62. The permanently engaged gearing 33 and 85 causes cinching gear to rotate from the position shown in FIG. 5 to a respective secondary position shown in phantom in FIG. 5. At this point the notch 88 becomes spaced away from pawl 86.

Switch member 84*a* which moves simultaneously with cinching gear 82 cooperates with a motor control circuit inside switch housing 70 energizing motor 100 to pull on cable 98. (The control circuit is electrically connected to motor 100 in any suitable manner.) As cable 98 is pulled, drive lever 90 is pulled against the bias of return spring 94. The drive lever 90 rotates about its mounting pin 83 and carries pawl 86 from the home position shown in FIGS. 5 and 6 to the position shown in FIGS. 7 and 8 where the pawl 86 reengages the notch 88. The motor 100 continues to pull on cable 98. The cable 98 in turn causes the cinching pawl 86 to drive against the cinching gear till the cinching gear 82 drives forkbolt 30 to its primary latch position shown in FIGS. 9 and 10 and where detent 32 engages primary latch shoulder 60. Detent 32 prevents the forkbolt 30 from rotating back to the open position and maintains the latch in a fully closed condition.

Figure 12:
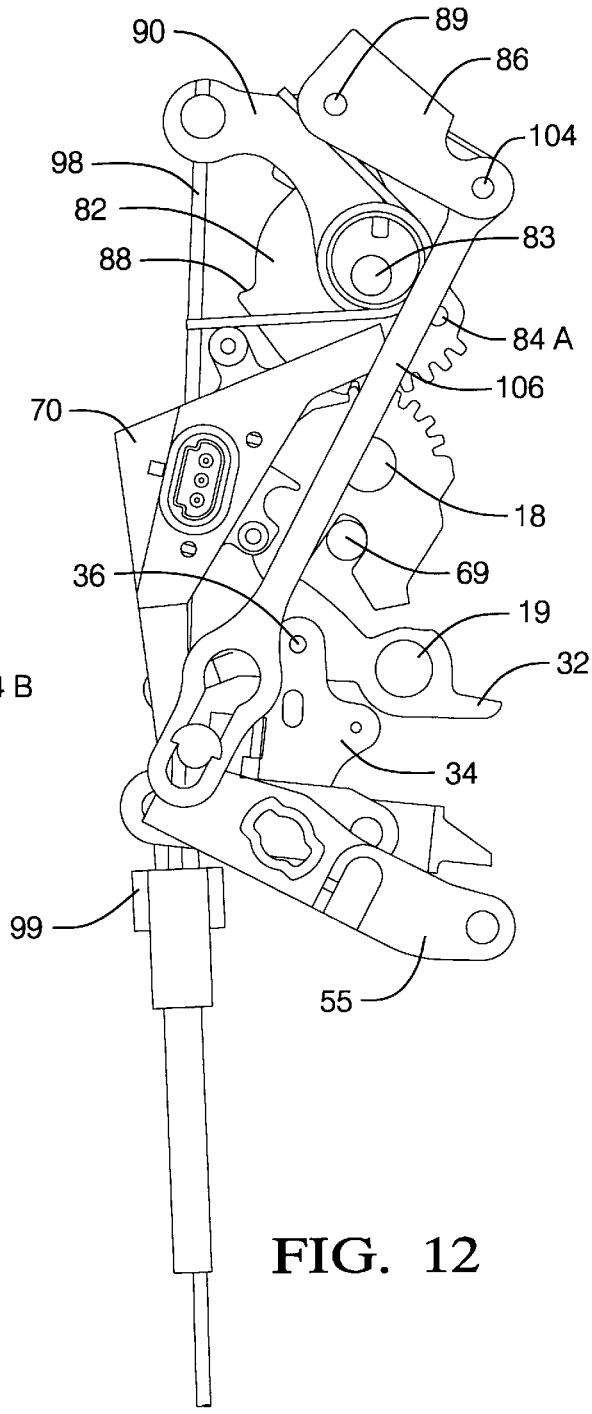
FIG. 12 is a fragmentary rear elevational view showing the vehicle door latch in FIG. 11.

Switch member 84*a* and a second switch member 84*b* which moves simultaneously with detent 32 cooperate with the motor control circuit at the end of the latching stroke reversing the electric motor 100 until drive lever 90 is returned to the standby or home position and pawl is also returned to the home position as shown in FIGS. 11 and 12 whereupon switch member 84*a* cooperates with the motor control circuit to deenergize electric motor 100. Suitable switches and motor control circuits within and electrically connected to housing 70 are well known in the motor control art and need not be described in detail. Suffice it to state that drive lever 90 and cinching pawl 86 are returned to the standby position to allow future return of the cinching gear 82 to the unlatched position for the next cycle of operation.

It should be noted that the link 106 that follows the pawl 86 swings across the pivot pin 83 of the cinching gear 82 and drive lever 90 as the cinching mechanism 80 moves from the home or standby position to the full driving or cinching position as illustrated in FIGS. 6, 8, 10 and 12. Any change in distance between flange 67 and pivot point 104 is taken up by the slot 108.

The cinching mechanism 80 thus drives the forkbolt 30 to the primary latch position and assures that the door latch 10 is in the primary latch position even if the vehicle door is not closed with sufficient force to achieve the primary latch position.

Door latch 10 is unlatched in a conventional manner by pulling intermittent lever 34 down by operating either the inside or outside door handles 50,55 or the like to rotate transfer lever 44 clockwise and ear 46 down as viewed in FIG. 13. Ear 46 engages projection 48 of intermittent lever 34 and pulls intermittent lever down from the primary latch position shown in FIG. 11 to the unlatched position shown in FIG. 13. The lever 34 rotates detent 32 clockwise against its spring bias which in turn releases forkbolt 30 which then rotates counterclockwise under its spring bias as the strike member 69 is pulled out of slots 74 and 75 when the vehicle door is opened. The latching assembly reverts back to the position shown in FIGS. 5 and 6 ready to be closed again.

Figure 14:
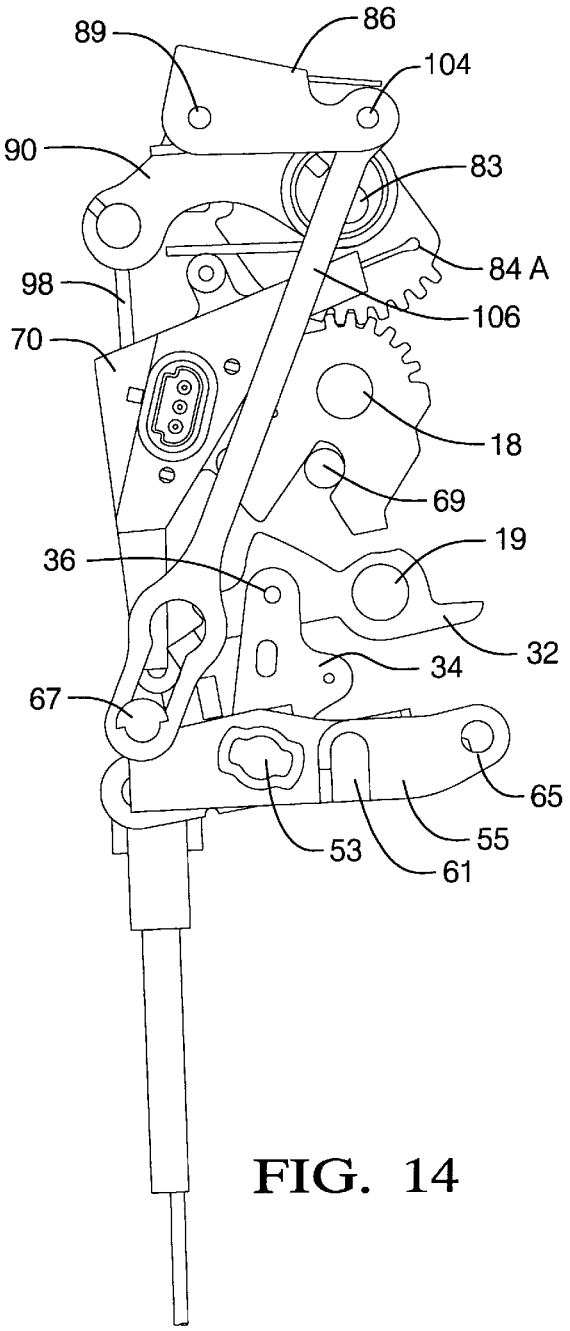
FIG. 14 is a fragmentary rear elevational view showing the vehicle door latch in FIG. 13.

The link 106 assures that door latch 10 can be unlatched in a conventional manner in the event that drive lever 90 jams for one reason or another, such as electric power loss to motor 100. If the motor 100 loses power while the pawl 86 is in engagement with notch 88 on cinch gear 82 during the cinching process, such as in the full cinch position shown in FIGS. 9 and 10, and the pawl 86 will not return to the standby position shown in FIGS. 11 and 12, the pawl 86 is merely disengaged by the pull of link 106 as caused by the operation of operating lever 55. This disengagement is illustrated in FIGS. 13 and 14. The pawl 86 rotates against its bias by spring 92 to radially pivot away from notch 88 and allow the cinching gear to rotate with forkbolt 30 under its own spring bias to the position shown in FIGS. 15 and 16. The geometry of the linkage 106 allows the pawl 86 to easily disengage from the notch 88. During this operation, the link 106 passes in proximity to pivot pin 83 of both the cinching gear 82 and drive lever 90.

Obviously, many modifications and variations of the present invention in light of the above teachings may be made. It is, therefore, to be understood that, within the scope of the appended claims, the invention may be practiced otherwise than as specifically described.

We claim:

1. A cinching mechanism for a vehicle latch assembly, said cinching mechanism comprising:

a cinching gear rotatably mounted about an axis between standby and latched positions and operatively interacting with the latch assembly and including a notch radially spaced away from said axis;

a cinch pawl operably movable between corresponding standby and latched positions corrected to an actuator and biased against said cinching gear for engagement with the notch of the cinching gear and driving the cinching gear to its latched position and for retracting to its standby position for allowing said cinching gear to rotate back to its standby position;

a cinch drive lever pivotably mounting said cinch pawl along a first pivot axis and being pivotably mounted in proximity to said axis of said cinching gear, said cinch lever operably connected to an actuator for driving said cinch pawl between its standby and latched positions;

a link pivotably connected to said cinch pawl at a predetermined point near one end and extending to and connected near its other end to the latch assembly for pivotably disengaging said cinch pawl from said cinching gear in response to unlatching action of the latch assembly;

said link in proximity to said pivot axis of said cinching gear such that a line between its one and other end crosses said axis of said cinching gear during motion of said cinch pawl between its standby and latched positions.

2. A cinching mechanism as defined in claim 1 further characterized by:

said cinching gear and cinch drive lever being coaxially mounted.

3. A cinching mechanism as defined in claim 2 further characterized by:

said cinch lever having a connection to a cable operably connected to said cinching gear actuator in proximity to one end and a pivotable connection to said link near a second end.

4. A cinching mechanism as defined in claim 3 further characterized by:

said link having a slot near its other end for connection to said latch assembly.

5. A cinching mechanism as defined in claim 4 further characterized by:

a casing mounting said cinching gear, cinch lever, cinch pawl and latch assembly with said link positioned on the exterior of said casing.

6. A cinching mechanism as defined in claim 1 further characterized by:

a casing mounting said cinching gear, cinch lever, cinch pawl and latch assembly with said link positioned on the exterior of said casing.

7. A cinching mechanism in combination with a latch assembly comprising:

a forkbolt pivotably mounted in the latch assembly having a gear section and a primary detent and biased to rotate to an open position;

a detent lever engageable with said primary detent and operable to lock said forkbolt from rotating;

an operating lever pivotably mounted in the latch assembly;

an intermediate lever engageable with said operating lever and linked to said detent lever;

a cinching gear rotatable about an axis between standby and latched positions and operatively engaged with said gear section of said forkbolt and including a notch radially spaced away from said axis;

a cinch pawl operably movable between corresponding standby and latched positions and biased against said cinching gear for engagement with said notch of said cinching gear and driving said cinching gear to its latched position and for retracting to its standby position for allowing said cinching gear to rotate back to its standby position;

a cinch drive lever pivotally mounting said cinch pawl along a first pivot axis and being pivotably mounted in proximity to said axis of said cinching gear, said cinch lever operably connected to an actuator for driving said cinch pawl between its standby and latched positions;

a link pivotably connected to said cinch pawl at a predetermined point near one end and extending to and connected near its other end to the latch assembly for pivotably disengaging said cinch pawl from said cinching gear in response to unlatching action of the latch assembly;

said link in proximity to said axis of said cinching gear such that a line between its one and other end crosses said axis of said cinching gear during motion of said cinch pawl between its standby and latched positions.

8. A cinching mechanism in combination with a latch assembly as defined in claim 7 further characterized by:

a casing mounting said cinching gear, cinch lever, cinch pawl and latch assembly with said link positioned on the exterior of said casing.

* * * * *